US011007556B2

(12) United States Patent
Ueoka et al.

(10) Patent No.: US 11,007,556 B2
(45) Date of Patent: May 18, 2021

(54) PRODUCTION EQUIPMENT LINE FOR HOT-ROLLED STEEL STRIP AND PRODUCTION METHOD FOR HOT-ROLLED STEEL STRIP

(71) Applicant: JFE Steel Corporation, Tokyo (JP)

(72) Inventors: Satoshi Ueoka, Tokyo (JP); Sonomi Shirasaki, Tokyo (JP); Yukako Katayama, Tokyo (JP); Takashi Matsumoto, Tokyo (JP); Yuta Tamura, Tokyo (JP)

(73) Assignee: JFE Steel Corporation, Tokyo (JP)

( * ) Notice: Subject to any disclaimer, the term of this patent is extended or adjusted under 35 U.S.C. 154(b) by 231 days.

(21) Appl. No.: 16/072,724

(22) PCT Filed: Jan. 16, 2017

(86) PCT No.: PCT/JP2017/001181
§ 371 (c)(1),
(2) Date: Jul. 25, 2018

(87) PCT Pub. No.: WO2017/130765
PCT Pub. Date: Aug. 3, 2017

(65) Prior Publication Data

US 2019/0030580 A1 Jan. 31, 2019

(30) Foreign Application Priority Data

Jan. 26, 2016 (JP) ..... JP2016-012185

(51) Int. Cl.
*B21B 45/02* (2006.01)
*B21B 1/26* (2006.01)
(Continued)

(52) U.S. Cl.
CPC ..... *B21B 45/0218* (2013.01); *B21B 1/26* (2013.01); *B21B 37/74* (2013.01); *B21B 45/0233* (2013.01); *B21B 2001/225* (2013.01)

(58) Field of Classification Search
CPC ..... B21B 45/0218; B21B 45/0233; B21B 45/0203; B21B 1/26; B21B 1/32;
(Continued)

(56) References Cited

U.S. PATENT DOCUMENTS 4,998,338 A * 3/1991 Seidel ..... B21B 1/26 164/476
8,051,695 B2 * 11/2011 Ueoka ..... B21B 45/0218 72/201
(Continued)

FOREIGN PATENT DOCUMENTS

CN 1483521 A 3/2004
CN 101253009 A 8/2008
(Continued)

OTHER PUBLICATIONS

Chinese Office Action for Chinese Application No. 201780008171.0, dated Mar. 4, 2019, with translation, 9 pages.
(Continued)

*Primary Examiner* — Shelley M Self
*Assistant Examiner* — Teresa A Guthrie
(74) *Attorney, Agent, or Firm* — RatnerPrestia

(57) ABSTRACT

A production equipment line for a hot-rolled steel strip comprises a rough rolling mill group comprised of plural rough rolling mills for hot rolling a material which is heated up to a predetermined temperature to a finish rolling start sheet thickness and a finish rolling mill group comprised of plural finish rolling mills for controlled-rolling the material to a final sheet thickness, wherein at least one of the plural rough rolling mills is a reversible rolling mill. The produc-
(Continued)

tion equipment line for a hot-rolled steel strip is provided with a slow cooling apparatus for slowly cooling the material at a water volume density of less than 1000 L/min·m$^2$ and a rapid cooling apparatus which is arranged next to the slow cooling apparatus and rapidly cools the material after the slow-cooling at a water volume density of not less than 1000 L/min·m$^2$.

20 Claims, 6 Drawing Sheets

(51) Int. Cl.
*B21B 37/74* (2006.01)
*B21B 1/22* (2006.01)

(58) Field of Classification Search
CPC ..... B21B 1/34; B21B 2001/225; B21B 37/74; B21B 37/76; B21B 1/02–06
USPC ..... 72/201, 229
See application file for complete search history.

(56) References Cited

U.S. PATENT DOCUMENTS

| | | | | |
|---|---|---|---|---|
| 8,231,826 | B2 * | 7/2012 | Ueoka | B21B 45/0281 266/113 |
| 8,318,080 | B2 * | 11/2012 | Ueoka | B21B 45/0218 266/44 |
| 8,404,062 | B2 * | 3/2013 | Ueoka | C21D 1/667 148/661 |
| 8,931,321 | B2 * | 1/2015 | Ueoka | B21B 45/0233 72/201 |

FOREIGN PATENT DOCUMENTS

| | | | | | |
|---|---|---|---|---|---|
| CN | 101862760 | A | | 10/2010 | |
| CN | 104525588 | A | | 4/2015 | |
| EP | 1935522 | A1 | | 6/2008 | |
| EP | 1935522 | A1 | * | 6/2008 | B21B 45/0218 |
| JP | 04274814 | A | | 9/1992 | |
| JP | 2000317501 | A | | 11/2000 | |
| JP | 2000317501 | A | * | 11/2000 | |
| JP | 2008246579 | A | | 10/2008 | |
| JP | 2008248291 | A | | 10/2008 | |
| JP | 2008290156 | A | | 12/2008 | |
| JP | 4720250 | B2 | | 7/2011 | |
| JP | 2011143459 | A | | 7/2011 | |
| JP | 4946516 | B2 | | 6/2012 | |
| JP | 2015217411 | A | | 12/2015 | |
| WO | 2008108483 | A1 | | 9/2008 | |

OTHER PUBLICATIONS

Extended European Search Report for European Application No. 17 743 996.5, dated Jan. 2, 2019—7 pages.
Korean Office Action for Korean Application No. 10-2018-7021494, dated Nov. 12, 2019, with Concise Statement of Relevance of Office Action, 7 pages.
International Search Report and Written Opinion for International Application No. PCT/JP2017/001181, dated Apr. 4, 2017—4 pages.
Japanese Office Action with Concise Statement of Relevance for Japanese Application No. 2016-012185, dated Jul. 5, 2017, 5 pages.

* cited by examiner

PRODUCTION EQUIPMENT LINE FOR HOT-ROLLED STEEL STRIP AND PRODUCTION METHOD FOR HOT-ROLLED STEEL STRIP

CROSS REFERENCE TO RELATED APPLICATIONS

This is the U.S. National Phase application of PCT/JP2017/001181, filed Jan. 16, 2017, which claims priority to Japanese Patent Application No. 2016-012185, filed Jan. 26, 2016, the disclosures of these applications being incorporated herein by reference in their entireties for all purposes.

TECHNICAL FIELD OF THE INVENTION

This invention relates to an equipment line and a method for producing a hot-rolled steel strip in which controlled-rolling is conducted in the production of thick hot-rolled steel strips having a thickness of not less than 12 mm and requiring a high toughness.

BACKGROUND OF THE INVENTION

FIG. 1 shows a general hot rolling process. In this rolling process, a material to be rolled (slab) heated to about 1200° C. through a continuous heating furnace 1 is first forged in a widthwise direction by a sizing press 2 to adjust a sheet width and then rolled by a rough rolling mill group 3 to form a sheet bar 10 having a thickness of 30-50 mm, and subsequently the sheet bar 10 is rolled by a finish rolling mill group 6 having 6-7 stands capable of performing continuous rolling up to 1.2-25 mm to obtain a rolled steel strip, which is then cooled by a runout table 7 and coiled by a coiler 8.

Since hot-rolled steel strips have hitherto been frequently used in press working, workability such as formability or the like has been considered to be important. In recent years, they has been used as a structural steel sheet represented by a linepipe or the like, so that strength and toughness are frequently required. The structural steel sheet is very thick having a thickness of 8-25 mm among the hot-rolled steel strips and particularly has a thickness of not less than 12 mm as a raw material for a linepipe. In order to increase the strength and toughness, it is advantageous to perform a controlled-rolling (CR) in the production process of the hot-rolled steel strips. The controlled-rolling has been mainly performed in the production process of thick steel plates since long ago and is a technique of increasing the toughness by rolling at a low temperature zone, where the crystal grain growth rate of steel is slow, to make crystal structure fine.

In general, a temperature for starting the controlled-rolling differs in accordance with an additive element such as Nb, V or the like and is roughly not higher than 950° C. The controlled-rolling is conducted at a rolling reduction of about at least 60% from a controlled-rolling start thickness to a product thickness. For example, when the controlled-rolling is performed at a rolling reduction of 60%, the controlled-rolling start thickness is about 30 mm in the case that the final thickness of the hot-rolled steel sheet is set to 12 mm, while the controlled-rolling start thickness is about 63 mm in the case that the final thickness is set to 25 mm. In the production process of a usual hot-rolled steel sheet, when the final thickness is set to 25 mm, there is adopted a method wherein rough rolling is first conducted to render a sheet thickness of a sheet bar into 63 mm until the end of the rough rolling and then the sheet bar is air-cooled while waiting before a finish rolling mill group 6 until a central temperature of the sheet bar arrives at not higher than 950° C. and thereafter rolled in the finish rolling mill group 6. In this case, the waiting time of the sheet bar before the finish rolling mill group 6 is required to be about 200-300 seconds, during which time a next material cannot be rolled, so that the rolling efficiency is largely decreased. As to the production line of the hot-rolled steel strip, there are only a few prior art documents for solving the above problems, but many examinations are made in the production line of thick steel sheets, and the following techniques are disclosed for example.

PRIOR ART DOCUMENTS

Patent Documents

Patent Document 1: JP-A-2011-143459
Patent Document 2: Japanese Patent No. 4720250
Patent Document 3: JP-A-H04-274814
Patent Document 4: Japanese Patent No. 4946516

SUMMARY OF THE INVENTION

The technique disclosed in Patent Document 1 is a method wherein a water cooling apparatus of about 15-300° C./sec is arranged at an entry side or an exit side of a reversible type rough rolling mill and cooling is performed between rolling passes of the rough rolling mill, or the cooling of the material to be rolled is performed by the water cooling apparatus at a stage that the sheet thickness is thicker than the controlled-rolling start thickness, whereby the controlled-rolling start temperature is set to a target value by the time of starting the controlled-rolling. However, this method has a problem that when the cooling rate is high and the sheet thickness is large, a temperature difference between the surface and the center of the steel material becomes large and hence there is a possibility that the surface layer temperature of the sheet bar may fall below a phase transformation temperature during the water cooling. In this case, only the surface layer of the sheet bar may cause phase transformation, and there is a possibility that a mechanical test value does not satisfy a given value.

The technique disclosed in Patent Document 2 is a method of simultaneously rolling plural materials to be rolled, wherein the material to be rolled is temporarily made to wait on a transporting table far removed from the rolling mill after the completion of the rolling to a thickness before the controlled-rolling, during which a next material is rolled to minimize an idling time of the rolling mill. In this technique, when the waiting time up to the start of the controlled-rolling by air cooling and the rolling time are substantially consistent, the effect of increasing the efficiency is large. However, there is a problem that when they are largely different, the rolling efficiency is not so increased.

Patent Document 3 discloses a lifting apparatus provided with a cantilever fork-shaped arm for lifting the steel sheet after the completion of the rolling before the controlled-rolling up to a height capable of passing a next material to be rolled and holding it in a waiting state. This is a very useful technique when the thickness of the sheet bar is sufficiently thick and the waiting time of the waiting sheet bar is consistent with the rolling time of the passing sheet bar. In the hot-rolled steel strip, however, a weight of a slab is as large as 20-30 tons as compared to that of the thick steel plate and the sheet bar has a very long length exceeding 20 m for example, so that a large-scale lifting apparatus is required. Also, the arm of the lifting apparatus and the sheet bar keep contact with each other for a long time, so that there is a problem that the temperature of the contact portion becomes low. Furthermore, it is suggested that the rolling can be performed with a waiting apparatus while leaving behind the next material, but it is not described how to conduct rolling in order to decrease a vacant time of a hot rolling mill to increase the rolling efficiency when a controlled-rolling material requiring waiting the cooling is included.

Patent Document 4 discloses that a water-cooling apparatus is disposed before and after the rolling mill in addition to the lifting apparatus of Patent Document 3 in order to reinforce the weakness of the above documents. Even in this patent document, however, it is not described how to conduct rolling on sheet bars of various sizes and temperature conditions in order that a vacant time of a hot rolling mill can be decreased to increase the rolling efficiency like in Patent Document 3.

It is, therefore, an object according to aspects of the invention to propose a production equipment line for a hot-rolled steel strip and a production method for a hot-rolled steel strip in which a hot-rolled steel strip can be produced efficiently by decreasing a time required up to the start of the controlled-rolling while preventing the temperature of a surface layer of the sheet bar from falling below a phase transformation temperature during cooling conducted prior to the controlled rolling.

A production equipment line for a hot-rolled steel strip according to aspects of the invention for advantageously solving the above task is a production equipment line for a hot-rolled steel strip comprising a rough rolling mill group comprised of plural rough rolling mills for hot rolling a material to be rolled which is heated up to a predetermined temperature to a finish rolling start sheet thickness and a finish rolling mill group comprised of plural finish rolling mills for controlled-rolling the material to be rolled to a final sheet thickness, characterized in that at least one of the plural rough rolling mills is a reversible rolling mill, and a slow cooling apparatus for slowly cooling the material to be rolled at a water volume density of less than 1000 L/min·m$^2$ and a rapid cooling apparatus which is arranged next to the slow cooling apparatus in a rolling direction and rapidly cools the material to be rolled after the slow-cooling at a water volume density of not less than 1000 L/min·m$^2$ are arranged on an upstream side or a downstream side of the reversible rolling mill. Here, the term "next to" means that the slow cooling apparatus and the rapid cooling apparatus are directly arranged adjacent to each other without disposing the rough rolling mill between the mutual apparatuses.

In the production equipment line for a hot-rolled steel strip according to aspects of the invention, it is preferable that at least a rough rolling mill arranged on a most downstream side among the plural rough rolling mills is a reversible rolling mill.

In the production equipment line for a hot-rolled steel strip according to aspects of the invention, it is preferable that the rapid cooling apparatus and the slow cooling apparatus are arranged in the order of the rapid cooling apparatus and the slow cooling apparatus from the side near to the reversible rolling mill.

In the production equipment line for a hot-rolled steel strip according to aspects of the invention, it is preferable that the material to be rolled is slowly cooled by the slow cooling apparatus when the sheet thickness is not less than 80 mm and rapidly cooled by the rapid cooling apparatus when the sheet thickness is less than 80 mm.

In the production equipment line for a hot-rolled steel strip according to aspects of the invention, it is preferable that each cooling time in the slow cooling apparatus and the rapid cooling apparatus is set so as to render a surface temperature of the material to be rolled during the cooling into not lower than 600° C.

In the production equipment line for a hot-rolled steel strip according to aspects of the invention, it is preferable that a sheet thickness at an exit side of a final-stage finish rolling mill among the plural finish rolling mills is not less than 12 mm.

Also, a method for producing a hot-rolled steel strip according to aspects of the invention for advantageously solving the above task is a method for producing a hot-rolled steel strip by hot rolling a material to be rolled heated to a predetermined temperature by a plurality of rough rolling mills to provide a finish rolling start sheet thickness and controlled-rolling the material to be rolled to a finish sheet thickness by a plurality of finish rolling mills, characterized in that at least one of the plural rough rolling mills is a reversible rolling mill, and the material to be rolled is slowly cooled by a slow cooling apparatus at a water volume density of less than 1000 L/min·m$^2$ and the material to be rolled after the slow cooling is rapidly cooled by a rapid cooling apparatus arranged next to the slow cooling apparatus in a rolling direction at a water volume density of not less than 1000 L/min·m$^2$ on an upstream side or a downstream side of the reversible rolling mill.

In the production method for a hot-rolled steel strip according to aspects of the invention, it is preferable that at least a rough rolling mill arranged on a most downstream side among the plural rough rolling mills is a reversible rolling mill.

In the production method for a hot-rolled steel strip according to aspects of the invention, it is preferable that the rapid cooling apparatus and the slow cooling apparatus are arranged in the order of the rapid cooling apparatus and the slow cooling apparatus from the side near to the reversible rolling mill.

In the production method for a hot-rolled steel strip according to aspects of the invention, it is preferable that the material to be rolled is slowly cooled by the slow cooling apparatus when the sheet thickness is not less than 80 mm and rapidly cooled by the rapid cooling apparatus when the sheet thickness is less than 80 mm.

In the production method for a hot-rolled steel strip according to aspects of the invention, it is preferable that the material to be rolled is cooled by the slow cooling apparatus and rapid cooling apparatus so as to render a surface temperature of the material to be rolled into not lower than 600° C. during the cooling.

In the production method for a hot-rolled steel strip according to aspects of the invention, it is preferable that a sheet thickness at an exit side of a final-stage finish rolling mill among the plural finish rolling mills is not less than 12 mm.

In the production equipment line for a hot-rolled steel strip and the production method for a hot-rolled steel strip according to aspects of the invention, the material to be rolled is first slowly cooled by the slow cooling apparatus at a water volume density of less than 1000 L/min·m$^2$ and then the material to be rolled after the slow cooling is rapidly cooled by the rapid cooling apparatus arranged next to the slow cooling apparatus in the rolling direction at a water volume density of not less than 1000 L/min·m$^2$ on the upstream side or downstream side of the reversible rolling mill. In an initial stage of the rolling, in which a sheet thickness is relatively large, slow cooling is performed by the slow cooling apparatus in which a cooling rate is relatively small but a surface layer temperature of the sheet bar does not fall below a phase transformation temperature even in the cooling for a relatively long time, whereby a large temperature dropping quantity can be ensured while preventing phase transformation of the surface layer of the sheet bar. In a later stage of the rolling in which the sheet thickness is relatively small, since a temperature difference between the center and the surface layer in the sheet bar is small and the temperature of the surface layer of the sheet bar is difficult to fall below the phase transformation temperature, a cooling rate can be increased by performing the rapid cooling by the rapid cooling apparatus, whereby the sheet bar can be cooled to a predetermined controlled-rolling start temperature for a short time.

In the production equipment line for a hot-rolled steel strip and the production method for a hot-rolled steel strip according to aspects of the invention, therefore, a time required up to the start of the controlled-rolling can be decreased while the temperature of the surface layer of the sheet bar is prevented from falling below the phase transformation temperature during the cooling conducted prior to the controlled-rolling, whereby hot-rolled steel strips can be produced efficiently.

DETAILED DESCRIPTION OF EMBODIMENTS FOR CARRYING OUT THE INVENTION

Figure 1:
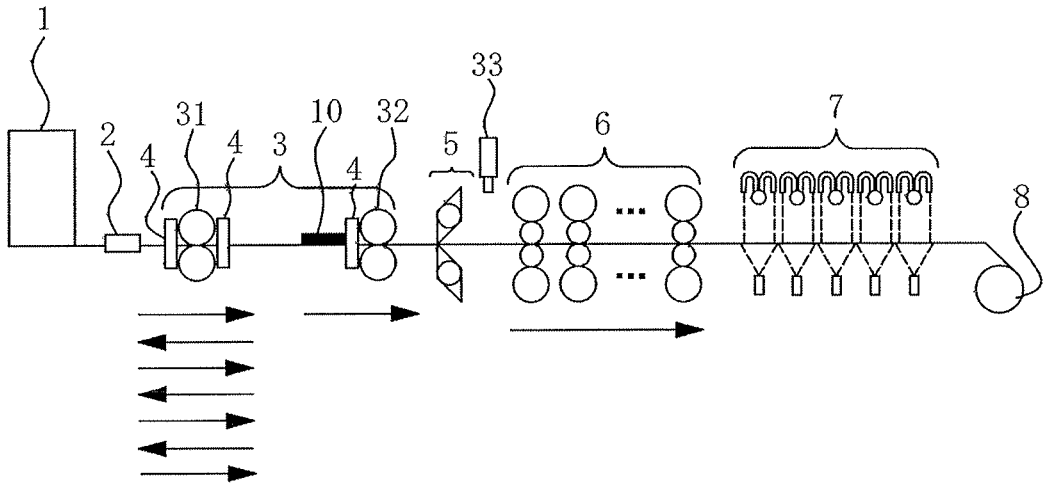
FIG. 1 is a schematic block diagram of a usual production equipment line for a hot-rolled steel strip together with a rolling pass.

A usual production equipment line and production method for a hot-rolled steel strip will be explained below, and an embodiment of the invention will be described in detail with reference to the accompanying drawings. FIG. 1 is a schematic block diagram of a usual production equipment line for a hot-rolled steel strip together with a rolling pass.

In the production of a usual hot-rolled steel strip, as shown in FIG. 1, a material to be rolled (slab) having, for example, a sheet thickness of 260 mm is heated to 1250° C. in a continuous heating furnace 1 and then shaped into a sheet bar 10 as a sheet-like material to be rolled having a predetermined thickness by a rough rolling mill group 3. In order to adjust the sheet width of the sheet bar 10, the material to be rolled is pressed to a given size in the widthwise direction by a sizing press 2 disposed at an exit side of the continuous heating furnace 1 and further pressed also in the widthwise direction by an edger 4 disposed in a position close to a rolling mill of the rough rolling mill group 3. Next, a front edge and a tail edge of the sheet bar 10 are cut by a crop shear 5, and thereafter the sheet bar 10 is finish-rolled to a predetermined thickness (for example, 20 mm) in a finish rolling mill group 6 to form a hot-rolled steel strip, which is then cooled to a given temperature in a runout table 7 and coiled with a coiler 8.

In the illustrated example, the rough rolling mill group 3 is comprised of two rough rolling mills 31 and 32, among which a reversible rolling mill 31 capable of rolling reversibly is arranged on an upstream side (heating furnace side) of the rough rolling mill group 3 and a non-reversible rolling mill 32 capable of rolling only in a transporting direction toward a downstream side is arranged on the downstream side thereof. In the rough rolling mill group 3, for example, the rolling of about 5-11 passes is performed through the reversible rolling mill 31 and then the rolling of only 1 pass is performed through the non-reversible rolling mill 32.

Conventionally, the sheet bar 10 rolled to a predetermined controlled-rolling start thickness is kept waiting under oscillation between the rough rolling mill group 3 and the finish rolling mill group 6 until the temperature thereof is lowered to a predetermined controlled-rolling start temperature. The surface temperature of the sheet bar 10 is measured with a radiation thermometer 33. After the surface temperature of the sheet bar 10 is confirmed to be decreased to the predetermined controlled-rolling start temperature, the sheet bar is transported to the finish rolling mill group 6 to perform controlled-rolling. In this case, it is necessary to keep the sheet bar waiting for about 60-300 seconds in order to decrease the temperature by about 150-250° C. by air cooling. During this period of time, the rolling cannot be performed in the finish rolling mill group 6, leading to the decrease of the rolling efficiency. When the thickness of the sheet bar 10 is 50 mm for example, the length of the sheet bar 10 is very long being about 50 m, so that it is not realistic to introduce a mechanism such as a lifting apparatus elevating the sheet bar or the like as disclosed in Patent Documents 3 and 4.

Therefore, an embodiment of the invention adopts a construction wherein cooling and rolling are simultaneously performed in the rough rolling mill group 3 by arranging a rapid cooling apparatus 41 having a water volume density of not less than 1000 L/min·m$^2$ and a slow cooling apparatus 42 having a water volume density of less than 1000 L/min·m$^2$ on one side (upstream side or downstream side) of the reversible rolling mill 31 in the rough rolling mill group 3. Thus, the temperature of the sheet bar 10 can be adjusted so as to become equal to the controlled-rolling start temperature at the completion of the rolling in the rough rolling mill group 3, and hence the waiting time for the controlled-rolling temperature can be largely shortened.

Figure 2:
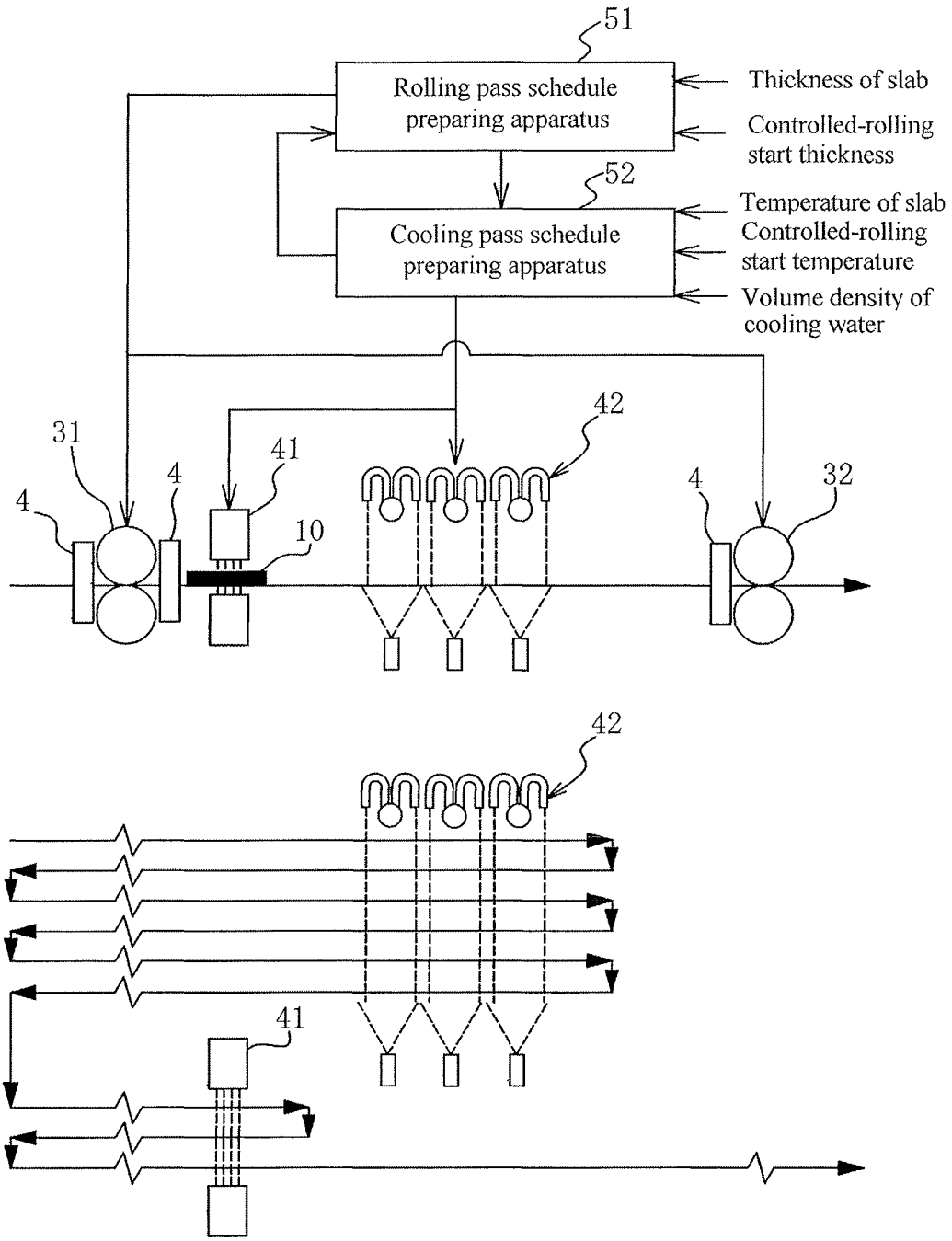
FIG. 2 is a schematic block diagram of an embodiment of the production equipment line for a hot-rolled steel strip according to aspects of the invention for carrying out an embodiment of the production method for a hot-rolled steel strip according to aspects of the invention together with a rolling pass and a cooling timing.

A concrete arrangement example of these cooling apparatus and a rolling method using them will be described below. FIG. 2 is a block diagram schematically showing an embodiment of the production apparatus for the hot-rolled steel strip according to aspects of the invention made by adding the rapid cooling apparatus 41 and the slow cooling apparatus 42 to the production equipment line shown in FIG. 1 for performing an embodiment of the production method for the hot-rolled steel strip according to aspects of the invention.

In this embodiment, as shown in FIG. 2, the rapid cooling apparatus 41 and the slow cooling apparatus 42 are arranged on the downstream side of the reversible rolling mill 31 in the order of the rapid cooling apparatus 41 and the slow cooling apparatus 42 from the side near to the reversible rolling mill 31 in the rolling direction. As the rolling pass and cooling timing are shown in a lower part of FIG. 2, reciprocal cooling is conducted in the initial rolling by operating the slow cooling apparatus 42 arranged farther than the rapid cooling apparatus 41 viewing from the reversible rolling mill 31 between rolling passes fed toward the downstream side (between the rolling and the next rolling) after the rolling in the reversible rolling mill 31 and also passing the sheet bar 10 through the slow cooling apparatus 42. When the sheet bar 10 has the predetermined thickness (late stage of rolling), discharge of water from the slow cooling apparatus 42 is stopped, while the rapid cooling apparatus 41 arranged nearer to the reversible rolling mill 31 than the slow cooling apparatus 42 is operated and the sheet bar 10 is passed through the rapid cooling apparatus 41 between rolling passes fed toward the downstream side after the rolling in the reversible rolling mill 31 and in transport to next step to perform cooling.

Figure 3:
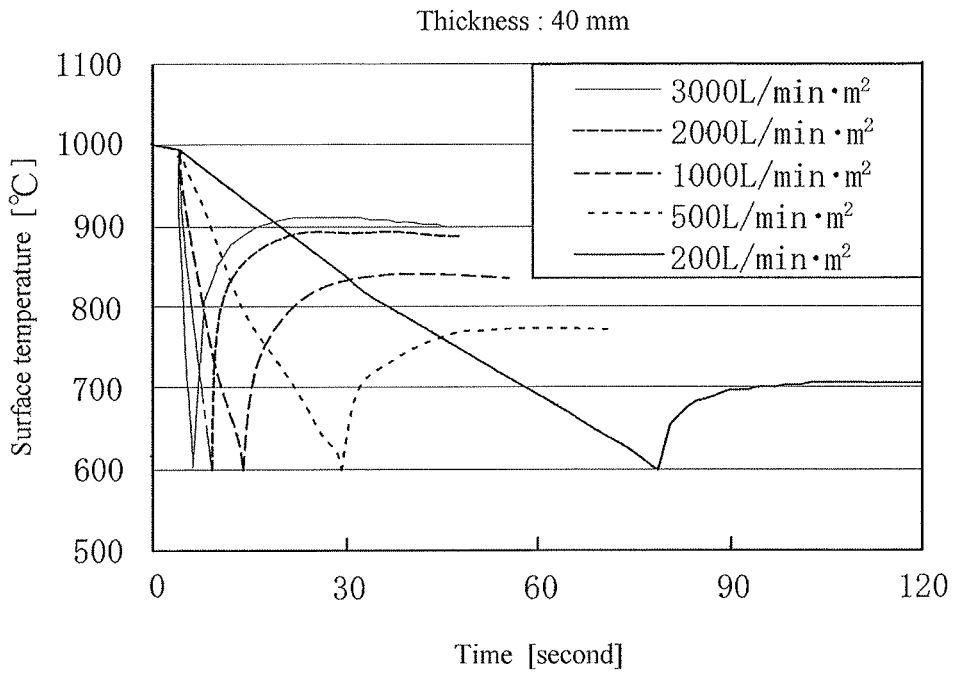
FIG. 3 is a graph showing a surface temperature history of a sheet bar when a sheet bar having a thickness of 40 mm is cooled at various volume densities of cooling water.
Figure 4:
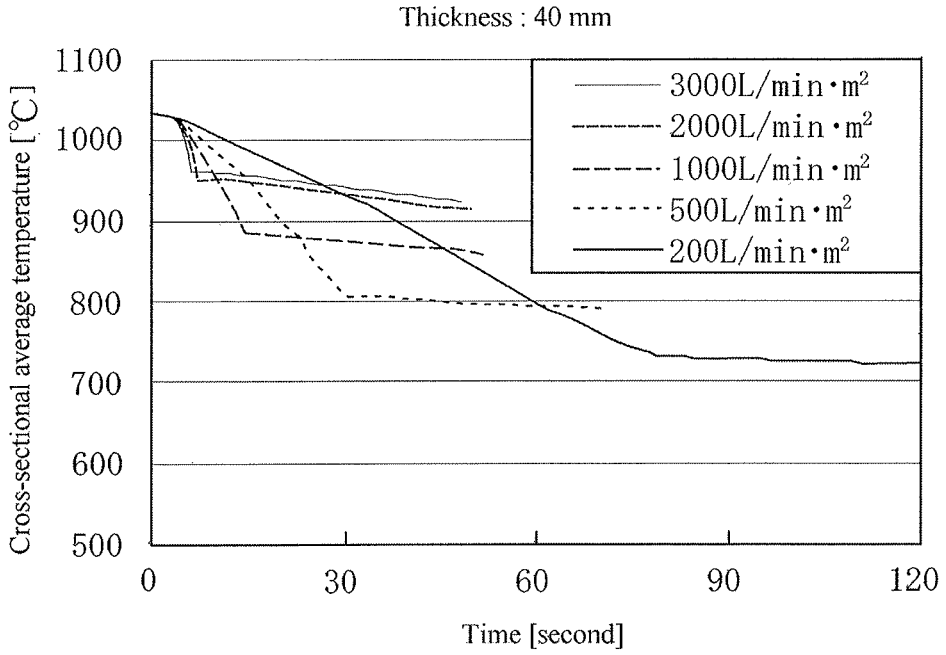
FIG. 4 is a graph showing a cross-sectional average temperature of a sheet bar when a sheet bar having a thickness of 40 mm is cooled at various volume densities of cooling water.

In this embodiment, the reason why the rapid cooling apparatus 41 and the slow cooling apparatus 42 are used properly in accordance with the thickness of the sheet bar 10, which is repeatedly rolled in the reversible rolling mill 31, is considered as follows. FIG. 3 shows a temperature history on the surface of the sheet bar 10 having a sheet thickness of 40 mm when cooled at various volume densities of cooling water as an example. In this figure, a region where the temperature is rapidly decreased shows that water cooling is conducted, and a time region where the temperature is increased through a lower limit temperature shows that water cooling is stopped and radiation cooling (air cooling) is conducted. As seen from this figure, a cooling rate of the surface (time-gradient of temperature) becomes faster as the water volume density of cooling water is increased. On the other hand, when the temperature of the sheet bar 10 falls below 600° C., phase transformation from austenitic structure to ferritic structure is caused. When the controlled-rolling is performed at such a state, there is a risk of decreasing surface ductility to cause cracking from ferrite grain boundary. Accordingly, the temperature at an outermost surface layer of the sheet bar 10 during the water cooling is preferable to be held at not lower than 600° C. In the example shown in FIG. 3, water cooling is stopped when the surface temperature of the sheet bar 10 arrives at a lower limit temperature of 600° C. from this viewpoint. FIG. 4 shows a cross-sectional average temperature of the sheet bar 10 at that time. Similarly, a time region where the temperature is rapidly decreased shows that water cooling is conducted. When the water volume density of the cooling water is high, a time-gradient of the cross-sectional average temperature of the sheet bar 10, or a cooling rate becomes steep, but the feed of the cooling water is stopped halfway from a viewpoint of holding the surface temperature at not lower than 600° C. to prevent cracking from ferrite grain boundary, so that the temperature at the end of cooling becomes higher as the water volume density of the cooling water becomes larger. Therefore, it can be seen that as the water volume density of the cooling water becomes smaller, the coolable temperature dropping quantity by one cooling can be increased although the cooling rate is slow.

Figure 5:
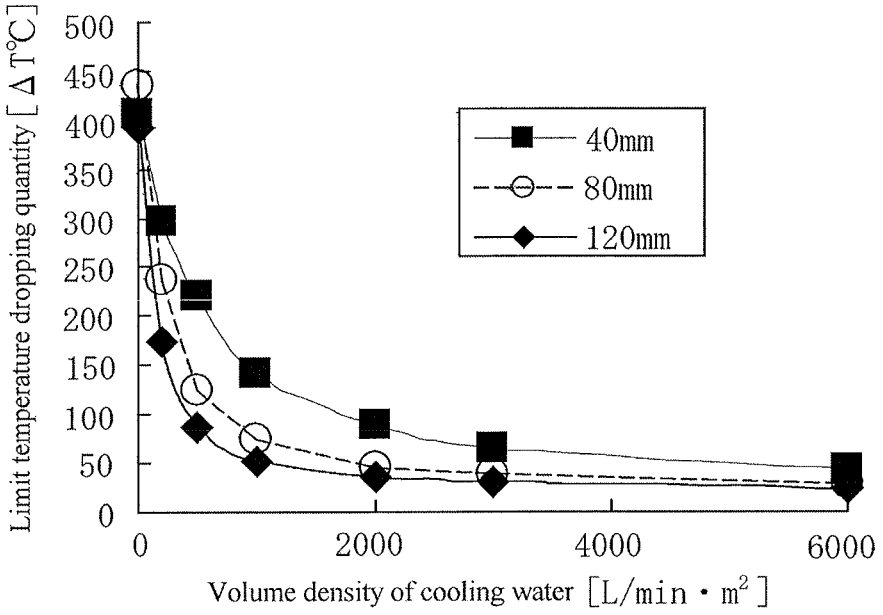
FIG. 5 is a graph showing a relation between a volume density of cooling water and a cross-sectional average limit temperature dropping quantity of a sheet bar when sheet bars having an initial surface temperature of 1000° C. and various sheet thicknesses are cooled to a sheet bar surface temperature of 600° C.

FIG. 5 shows a relation between a volume density of cooling water and a cross-sectional average temperature dropping quantity of sheet bars 10 having an initial surface temperature of 1000° C. and various sheet thicknesses when the sheet bars are cooled until the surface temperature becomes 600° C. As previously explained, since there is a restriction of holding the surface temperature at not lower than 600° C., as the sheet thickness becomes larger and the water volume density of the cooling water becomes larger, the temperature dropping quantity by one water cooling becomes smaller. Hereinafter, the temperature difference which can be dropped by one cooling due to the restriction of holding the surface temperature at not lower than 600° C. is called as a limit temperature dropping quantity.

Figure 6:
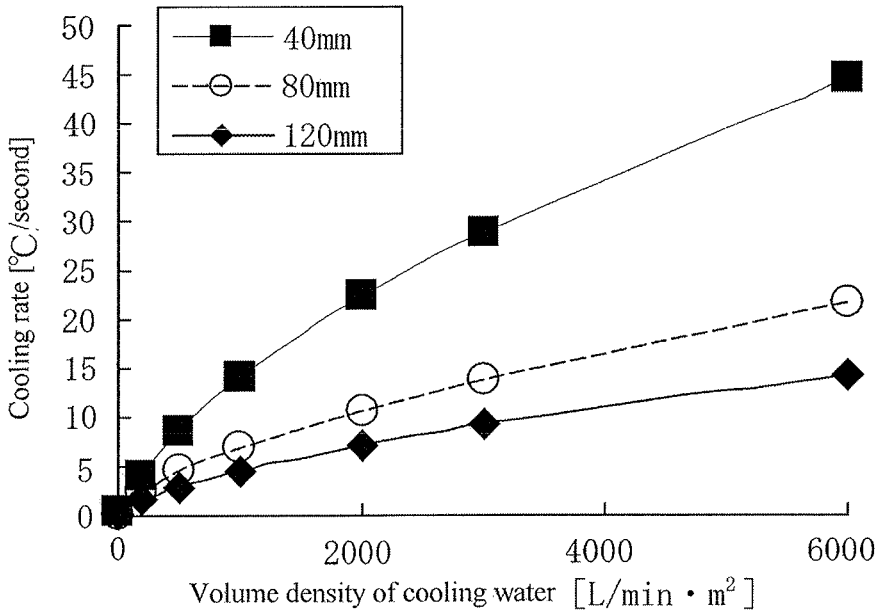
FIG. 6 is a graph showing a relation between a volume density of cooling water and a cross-sectional average cooling rate of sheet bars having an initial surface temperature of 1000° C. and various sheet thicknesses.

FIG. 6 shows a relation between a volume density of cooling water and a cross-sectional average cooling rate of sheet bars 10 having an initial surface temperature of 1000° C. and various sheet thicknesses. As the volume density of cooling water becomes larger, the cooling rate becomes faster. Considering the above restriction together, when cooling within the limit temperature dropping quantity is performed, as the water volume density of the cooling water becomes higher, the temperature can be dropped for a shorter time, which is advantageous in the shortening of the rolling time.

Considering the actual rolling process, a slab having a thickness of about 220-260 mm is rolled to about 45 mm by about 10 passes. In the initial stage of the rolling, the sheet thickness is large, so that the limit temperature dropping quantity tends to become small, and hence the slow cooling having a large limit temperature dropping quantity is advantageous from a viewpoint of a lower limit surface temperature per 1 pass. Under a condition that the sheet thickness is small in the later stage of the rolling, the limit temperature dropping quantity can be made larger, so that the rapid cooling which increases the cooling rate to perform water cooling for a short time becomes advantageous. Also, as the sheet thickness is smaller, the limit temperature dropping quantity is larger, so that when plural rough rolling mills are provided, it is preferable that the cooling is carried out on the upstream side or downstream side of the reversible rolling mill arranged on a most downstream side in accordance with the smallest sheet thickness.

As seen from FIG. 5, when the sheet thickness is as relatively large as 80 mm and 120 mm, the limit temperature dropping quantity becomes larger at a low water volume density when the water volume density of cooling water is not more than 1000 L/min·m$^2$. Therefore, a large limit temperature dropping quantity can be ensured by making the water volume density of the cooling water less than 1000

L/min·m$^2$ in the case of a sheet thickness of not less than 80 mm from a viewpoint of preventing ferrite cracking in the surface of the sheet bar 10.

In the embodiment of the invention, therefore, the cooling to a given temperature desirable for the controlled-rolling (controlled-rolling start temperature) is divided into plural passes, in which the cooling within a temperature range of about 20-30° C. is performed per 1 pass. Considering the above theory, the cooling is performed by the slow cooling apparatus 42 having a water volume density of less than 1000 L/min·m$^2$ in the initial rolling in which the sheet thickness is relatively large, particularly being not less than 80 mm, while the cooling is performed by the rapid cooling apparatus 41 having a water volume density of not less than 1000 L/min·m$^2$ in the later rolling in which the sheet thickness is relatively small, particularly being less than 80 mm, whereby efficient cooling can be performed while preventing ferrite cracking on the surface of the sheet bar 10, and the rolling time can be shortened.

In the slow cooling apparatus 42, as the water volume density of the cooling water is decreased, the temperature dropping quantity by water cooling per 1 pass becomes larger, but the cooling rate becomes slower, and hence the effect of increasing the efficiency becomes small. Therefore, the cooling water volume by the slow cooling apparatus 42 is preferable to be not less than 200 L/min·m$^2$. In the rapid cooling apparatus 41, as the volume density of cooling water becomes larger, the temperature dropping quantity by water cooling per 1 pass becomes smaller while the cooling rate becomes faster. Therefore, the increase of the equipment cost associated with the increase of the cooling water volume is caused within a range where the critical cooling capacity per 1 pass is not much changed, so that the water volume density of the cooling water is preferable to be not more than 6000 L/min·m$^2$.

Each of the cooling apparatuses 41 and 42 may be of any system such as group jet cooling comprising a plurality of round nozzles, pipe laminar, mist cooling, spray cooling and so on. In the rapid cooling apparatus 41, since the cooling water volume is large, thick retained water is liable to be generated on the sheet bar 10, and there is a possibility that stable cooling cannot be obtained because the retained water blocks collision of the jetted cooling water onto the surface of the steel sheet. Therefore, a group jet cooling apparatus having a plurality of round nozzles with a high penetrating power to a liquid film is preferable to be used as the rapid cooling apparatus 41. On the other hand, the slow cooling apparatus 42 has no limits, so that a pipe laminar system or a spraying system generally used in a cooling apparatus for hot-rolled steel strips can be used.

Figure 7:
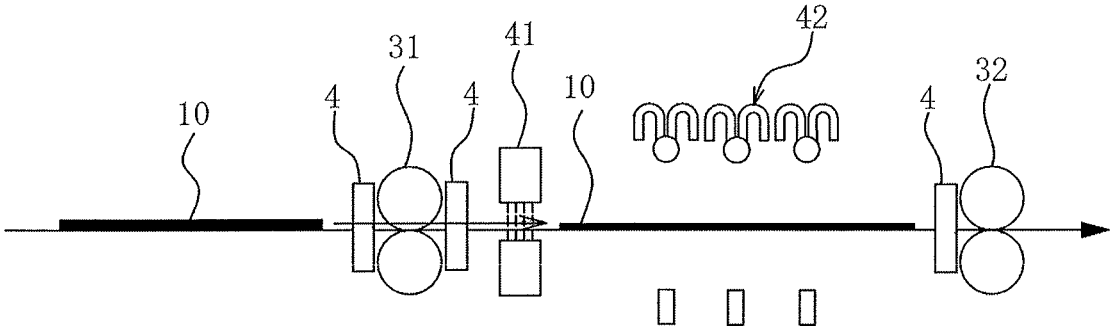
FIG. 7 is a diagram showing how a sheet bar is cooled by a rapid cooling apparatus arranged near to a reversible rolling mill in a production equipment line shown in FIG. 2.

A preferable arrangement of the cooling apparatuses 41 and 42 will be described below. It is preferable that the rapid cooling apparatus 41 is arranged in a position near to the reversible rolling mill 31 in the rolling direction and the slow cooling apparatus 42 is arranged at a position far therefrom. In this embodiment, the cooling apparatus are used properly in accordance with the thickness of the sheet bar 10. The sheet thickness is decreased by rolling the sheet bar 10 at each rolling pass, so that the length of the sheet bar 10 is gradually prolonged by the rolled quantity. That is, the length of the sheet bar becomes longest in a zone where the sheet thickness is small using the rapid cooling apparatus 41. In the conventional layout of the rough rolling mill group, an interval between each rolling mill is decided depending on the pass schedule of the design specification. Accordingly, when a long sheet bar 10 is cooled by passing through the cooling apparatuses 41 and 42, it is feared that the sheet bar 10 may reach to the adjoining rolling mill at a time of leaving from the cooling apparatuses 41 and 42 to cause interference. Therefore, the rapid cooling apparatus 41 for cooling the sheet bar 10 having a small sheet thickness and long length is preferable to be arranged in a position near to the reversible rolling mill 31 as shown in FIG. 7.

A pass cooling is preferable as the cooling system of the rapid cooling apparatus 41. In this case, it is necessary that the rolling rate and the passing rate in the rapid cooling apparatus 41 have the same value in order to simultaneously perform the rolling and the water cooling. To this end, a distance between the reversible rolling mill 31 and the rapid cooling apparatus 41 is preferable to be small as much as possible. However, the edger 4, rolling guide and so on are usually arranged around the reversible rolling mill 31, and there is a limit in the close arrangement, so that the rapid cooling apparatus 41 is preferable to be arranged within 25 m from the reversible rolling mill 31.

Figure 8:
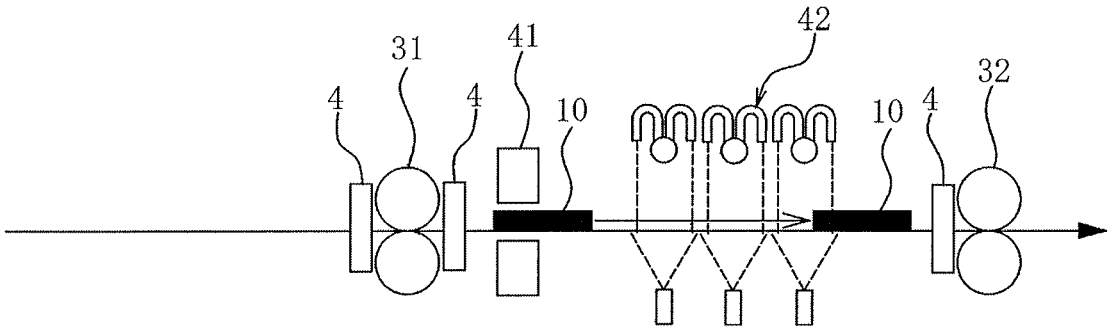
FIG. 8 is a diagram showing how a sheet bar is cooled by a slow cooling apparatus arranged far from a reversible rolling mill in a production equipment line shown in FIG. 2.

Since the slow cooling apparatus 42 is used for the sheet bar 10 having a relatively large sheet thickness as shown in FIG. 8, it is preferable to be arranged in an approximately central position between the adjoining rough rolling mills 31 and 32 so that the sheet bar 10 after passing through the slow cooling apparatus 42 does not interfere with the next non-reversible rolling mill 32. When the distance between the reversible rolling mill 31 and the slow cooling apparatus 42 and the distance between the slow cooling apparatus 42 and the non-reversible rolling mill 32 arranged next thereto are larger than the length of the sheet bar 10 to be water-cooled, the sheet bar 10 may pass through the slow cooling apparatus 42 by varying a passing rate after the rolling in the reversible rolling mill 31, whereby a temperature dropping quantity in the cooling can be adjusted freely. From such a viewpoint, the slow cooling apparatus 42 is preferable to be arranged in a central position between the adjacent rough rolling mills 31 and 32. Also, when the length of the sheet bar 10 is smaller than that of the slow cooling apparatus 42, the cooling may be performed while stopping or oscillating the sheet bar 10 after the sheet bar 10 is transported just beneath the slow cooling apparatus 42, instead of the pass cooling.

The production equipment line for the hot-rolled steel strip according to this embodiment may be provided with a rolling pass schedule preparing apparatus 51 and a cooling pass schedule preparing apparatus 52 as shown in FIG. 2. The rolling pass schedule preparing apparatus 51 is constructed with a personal computer or the like, wherein pass schedules of a rolling reduction, pass number and the like in each of the rough rolling mills 31 and 32 are calculated and prepared from the input slab thickness, controlled-rolling start thickness and the like so as to decrease the pass number within the limit of rolling reduction in each rolling pass as much as possible.

The cooling pass schedule preparing apparatus 52 is constructed with a personal computer or the like, wherein slow cooling by the slow cooling apparatus 42 is allocated in the case that the thickness of the sheet bar 10 is not less than 80 mm and rapid cooling by the rapid cooling apparatus 41 is allocated in the case that the thickness of the sheet bar 10 is less than 80 mm to each cooling pass based on the thickness of the sheet bar 10 and the like after the each rolling pass calculated by the rolling pass schedule preparing apparatus 51, while a cooling pass number and cooling time are calculated from a relation between the volume density of cooling water and temperature dropping quantity for a predetermined sheet thickness obtained by pre-experiments or the like and a relation between the surface temperature and cooling time of a sheet bar 10 for a predetermined volume density of cooling water obtained by pre-experiments or the like. In this case, the cooling pass schedule preparing apparatus 52 calculates a cooling time and passing rate in the slow cooling apparatus 42 and the rapid cooling apparatus 41 in such a manner so that the surface temperature of the sheet bar 10 does not fall below 600° C. during the cooling. Moreover, the cooling pass schedule prepared by the cooling pass schedule preparing apparatus 52 may be fed back to the rolling pass schedule preparing apparatus 51. When the rolling pass number is lacking for the calculated cooling pass number, a rolling pass with a rolling reduction of zero is added by the rolling pass schedule preparing apparatus 51 and water cooling may be performed after this rolling pass. The thus prepared rolling pass schedule and cooling pass schedule are output to each of the rough rolling mills 31 and 32 and cooling apparatuses 41 and 42, whereby rolling and cooling in each apparatus of 31, 32, 41, and 42 are conducted according to these schedules.

In the above embodiment is shown the example of arranging the rapid cooling apparatus 41, slow cooling apparatus 42 and non-reversible rolling mill 32 in this order on the downstream side of the reversible rolling mill 31 in the rolling direction. However, the rapid cooling apparatus 41 and the slow cooling apparatus 42 may be arranged in this order from the side near to the reversible rolling mill 31 on the upstream side of the reversible rolling mill 31. In the illustrated example, water cooling of the sheet bar 10 is performed after the end of odd rolling passes. However, when the rapid cooling apparatus 41 and the slow cooling apparatus 42 are arranged in this order from the side near to the reversible rolling mill 31 on the upstream side of the reversible rolling mill 31, water cooling is performed before the first rolling pass and at the end of even rolling passes.

Figure 9:
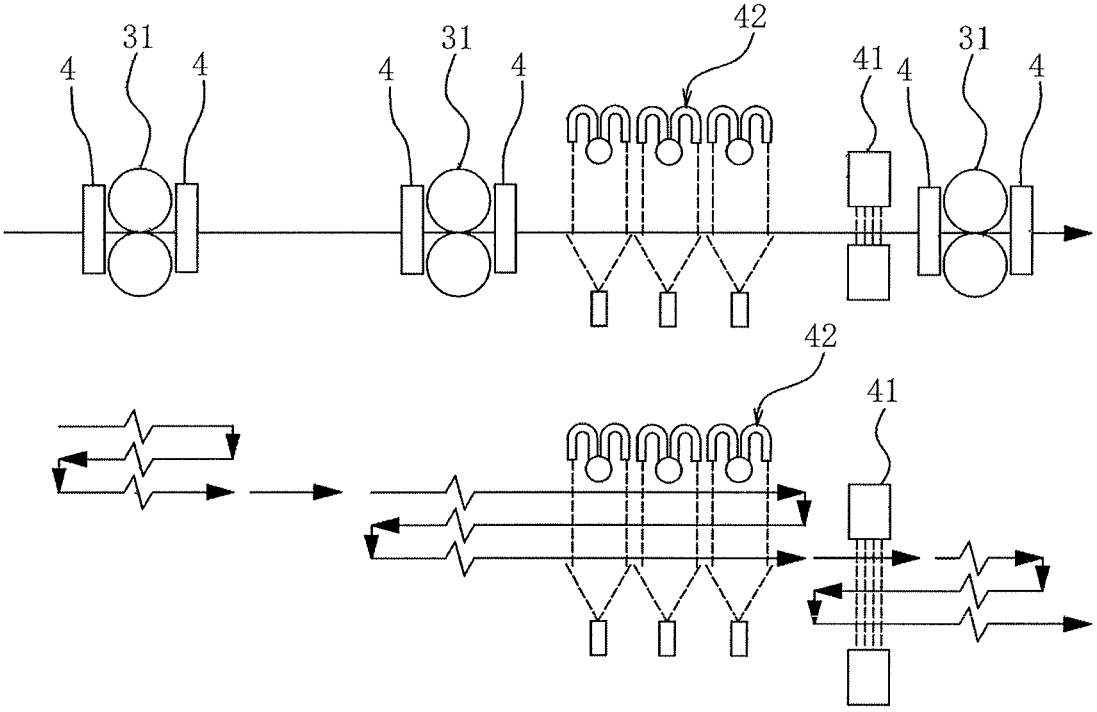
FIG. 9 is a schematic block diagram of another embodiment of the production equipment line for a hot-rolled steel strip according to aspects of the invention for carrying out another embodiment of the production method for a hot-rolled steel strip according to aspects of the invention together with a rolling pass and a cooling timing.

In the above embodiment, it is explained that the rough rolling mill group 3 is comprised of one reversible rolling mill 31 and one non-reversible rolling mill 32. However, the rough rolling mill group 3 may be provided with a plurality of reversible rolling mills 31. FIG. 9 shows a production equipment line for a hot-rolled steel strip according to another embodiment of the invention and a production method for a hot-rolled steel strip using the same. In the embodiment shown in the figure, the rough rolling mill group 3 is comprised of three reversible rolling mills 31. On an upstream side of the reversible rolling mill 31 arranged at a most downstream side viewing in the rolling direction are arranged the rapid cooling apparatus 41 and the slow cooling apparatus 42 in this order from the side near to the reversible rolling mill 31. In a lower part of this figure is also shown a water cooling timing in the rolling process. In this production equipment line, rolling is started from the reversible rolling mill 31 arranged at the most upstream side on the left of the figure, and rolling of 3 passes is conducted in each of the reversible rolling mills 31. In the central reversible rolling mill 31, cooling is performed by the slow cooling apparatus 42 after the end of odd rolling passes and thereafter cooling is performed by the rapid cooling apparatus 41 during the transportation from the central reversible rolling mill 31 to reversible rolling mill 31 arranged at the most downstream side on the right side and at the end of even rolling passes.

EXAMPLE

An example according to the invention will be described below. A rolling raw material to be a target (material to be rolled) is a steel material, which has a product thickness of 18 mm or 24 mm and a controlled-rolling reduction of 60% as shown in the following Table 1. That is, a controlled-rolling start thickness is 45 mm or 60 mm. Also, a controlled-rolling start temperature is 850° C. In Comparative Examples 1 and 2 using a line shown in FIG. 1, the rolling raw material is heated to 1150° C. in a continuous heating furnace 1 and then rolled by a rough rolling mill group 3 to a controlled-rolling start thickness shown in Table 1 to form a sheet bar 10, which is subjected to rolling by a finish rolling mill group 6 after a surface temperature of the sheet bar 10 is confirmed to be 850° C.±10° C. by means of a radiation thermometer 33. When the temperature of the sheet bar 10 is higher than a target controlled-rolling start temperature, the sheet bar 10 is kept waiting between the rough rolling mill group 3 and the finish rolling mill group 6 under oscillation until a predetermined controlled-rolling start temperature is obtained.

TABLE 1

| | Heating temperature | Product thickness | Controlled-rolling start thickness (Thickness before finish rolling) | Controlled-rolling start temperature (Finish rolling temperature) | Slow cooling apparatus | Rapid cooling apparatus |
|---|---|---|---|---|---|---|
| Example 1 | 1150° C. | 18 mm | 45 mm | 850° C. | 22 sec | 5 sec |
| Example 2 | 1150° C. | 24 mm | 60 mm | 850° C. | 40 sec | 5 sec |
| Comparative Example 1 | 1150° C. | 18 mm | 45 mm | 850° C. | No use | No use |
| Comparative Example 2 | 1150° C. | 24 mm | 60 mm | 850° C. | No use | No use |

In Examples 1 and 2, water cooling is performed in a rough rolling process by arranging a rapid cooling apparatus 41 and a slow cooling apparatus 42 between a reversible rolling mill 31 (upstream side) and a non-reversible rolling mill 32 (downstream side) in a rough rolling mill group 3 as, shown in FIG. 2. The rolling and water cooling in Example 1 are conducted according to a pass schedule described in Table 2, while the rolling and water cooling in Example 2 are conducted according to a pass schedule described in Table 3. Similarly, rolling in Comparative Example 1 and rolling in Comparative Example 2 are conducted according to the pass schedule of Table 2 and the pass schedule of Table 3, respectively, and water cooling is not conducted in Comparative Examples.

TABLE 2

| Rolling pass | Rolling mill No. | Type of rolling mill | Rolling direction | Thickness after rolling mm | Cooling pass | Cooling apparatus |
|---|---|---|---|---|---|---|
| 1 | 1 | Reversible type | Downstream side | 230 | Presence (twice) | Slow cooling apparatus |
| 2 | 1 | Reversible type | Upstream side | 190 | Absence | — |
| 3 | 1 | Reversible type | Downstream side | 150 | Presence (twice) | Slow cooling apparatus |
| 4 | 1 | Reversible type | Upstream side | 120 | Absence | — |
| 5 | 1 | Reversible type | Downstream side | 90 | Presence (twice) | Slow cooling apparatus |
| 6 | 1 | Reversible type | Upstream side | 85 | Absence | — |
| 7 | 1 | Reversible type | Downstream side | 75 | Presence (twice) | Rapid cooling apparatus |
| 8 | 1 | Reversible type | Upstream side | 65 | Absence | — |
| 9 | 1 | Reversible type | Downstream side | 55 | Presence (once) | Rapid cooling apparatus |
| 10 | 2 | Non-reversible type | Downstream side | 45 | Absence | — |

TABLE 3

| Rolling pass | Rolling mill No. | Type of rolling mill | Rolling direction | Thickness after rolling mm | Cooling pass | Cooling apparatus |
|---|---|---|---|---|---|---|
| 1 | 1 | Reversible type | Downstream side | 230 | Presence(twice) | Slow cooling apparatus |
| 2 | 1 | Reversible type | Upstream side | 190 | Absence | — |
| 3 | 1 | Reversible type | Downstream side | 160 | Presence(twice) | Slow cooling apparatus |
| 4 | 1 | Reversible type | Upstream side | 130 | Absence | — |
| 5 | 1 | Reversible type | Downstream side | 100 | Presence(twice) | Slow cooling apparatus |
| 6 | 1 | Reversible type | Upstream side | 85 | Absence | — |
| 7 | 1 | Reversible type | Downstream side | 70 | Presence(once) | Rapid cooling apparatus |
| 8 | 2 | Non-reversible type | Downstream side | 60 | Absence | — |

In the rapid cooling apparatus 41 is used a group jet cooling apparatus constructed by arranging a plurality of round tube nozzles with a hole diameter of 5 mm at a pitch of 60 mm in a transportation direction (rolling direction) and a widthwise direction, in which a volume density of cooling water is 3000 L/min·m$^2$. In the slow cooling apparatus 42 are used a hairpin type pipe laminar cooling apparatus disposed at an upper face side of the sheet bar 10 and a spray cooling apparatus disposed at a lower face side of the sheet bar 10, in which a volume density of cooling water is 900 L/min·m$^2$. Further, a rolling rate and a rate passing through the cooling apparatus are controlled so as to render the surface temperature of the sheet bar 10 during the cooling into not lower than 600° C. As a result, a time for transporting the sheet bar 10 from the reversible rolling mill 31 to the rapid cooling apparatus 41 and returning it to the rolling mill 31 after the cooling is 5 seconds as shown in Table 1. Also, a time for transporting the sheet bar 10 from the reversible rolling mill 31 to the slow cooling apparatus 42 and returning it to the rolling mill 31 after the cooling is 22 seconds in the product thickness of 18 mm and 40 seconds in the product thickness of 24 mm as shown in Table 1.

In Table 4 are shown results obtained by actually rolling the rolling raw materials of Examples 1 and 2 and Comparative Examples 1 and 2 under the aforementioned conditions. Example 1 is a case where the product thickness is 18 mm, in which a waiting time before the finish rolling mill group 6 is about 10 seconds and a total of the waiting time and the rough rolling time is 428 seconds. Moreover, the waiting time of 10 seconds is a time required for confirming a temperature by means of a radiation thermometer 33 before the finish rolling mill group 6, so that a real waiting time is not caused. In Comparative Example 1, the rolling is performed according to the same rolling pass schedule as in Example 1. However, the cooling apparatuses 41 and 42 proposed in accordance with aspects of the present invention are not used in Comparative Example 1, so that a temperature of the sheet bar 10 when arriving at the finish rolling mill group 6 is 965° C., which is higher by 115° C. than a target temperature of 850° C., and hence the sheet bar is kept waiting (air cooled) for 170 seconds before the finish rolling mill group 6 until the target temperature is obtained. A total of the waiting time and the rough rolling time is 514 seconds, which is longer by 86 seconds than that in Example 1.

TABLE 4

| | Rough rolling pass schedule | Use of cooling apparatus | Temperature at entry side of finish rolling mill: On arrival | Temperature at entry side of finish rolling mill: Rolling start | Waiting time before finish rolling mill | Rough rolling time (take out from heating furnace - before finish rolling) | Waiting time + rough rolling time |
|---|---|---|---|---|---|---|---|
| Example 1 | Table 1 | Use | 856° C. | 852° C. | 10 sec | 418 sec | 428 sec |
| Example 2 | Table 2 | Use | 852° C. | 850° C. | 10 sec | 421 sec | 431 sec |
| Comparative Example 1 | Table 1 | No use | 965° C. | 852° C. | 170 sec | 344 sec | 514 sec |
| Comparative Example 2 | Table 2 | No use | 992° C. | 847° C. | 290 sec | 300 sec | 590 sec |

Example 2 is a case where the product thickness is 24 mm, in which the waiting time before the finish rolling mill group 6 is about 10 seconds as in Example 1 and a total of the waiting time and the rough rolling time is 431 seconds, which is approximately the same rolling time as in Example 1. Moreover, the waiting time of 10 seconds is a time required for confirming a temperature by means of a radiation thermometer 33 before the finish rolling mill group 6, so that a real waiting time is not caused.

In Comparative Example 2, the rolling is conducted according to the same rolling pass schedule as in Example 2. However, the cooling apparatuses 41 and 42 proposed in accordance with aspects of the present invention are not used in Comparative Example 2, so that a temperature of the sheet bar 10 when arriving at the finish rolling mill group 6 is 992° C., which is higher by 142° C. than a target temperature of 850° C., and hence the sheet bar is kept waiting (air cooled) for 290 seconds before the finish rolling mill group 6 until the target temperature is obtained. A total of the waiting time and the rough rolling time is 590 seconds, which is longer by 159 seconds than that in Example 2.

From the above experimental results, it has been confirmed that a time from when the sheet bar is taken out from the heating furnace to when the finish rolling is started is shortened by 86 seconds in the case of the material for the product thickness of 18 mm and by 159 seconds in the case of the material for the product thickness of 24 mm by arranging the rapid cooling apparatus 41 and the slow cooling apparatus 42 in the rough rolling mill group 3 and properly using the rapid cooling and the slow cooling in accordance with the thickness of the sheet bar.

Aspects of the invention are described based on the above illustrated examples. However, it is not limited thereto, so that proper modifications and addition may be performed within a scope described in claims. For example, the cooling by the rapid cooling apparatus 41 and the slow cooling apparatus 42 may not be performed after all of rolling passes feeding toward the cooling apparatuses 41 and 42. When the temperature dropping quantity by the water cooling is large and the temperature when arriving at the finish rolling mill falls below the predetermined start temperature of the finish rolling, water cooling in arbitrary pass may not be performed. When the water cooling is performed particularly in the slow cooling apparatus 42, the temperature dropping quantity may be adjusted by varying a passing rate at an entry side of the slow cooling apparatus 42 together with conducting pass cooling, or the temperature dropping quantity may be controlled by adjusting a jetting time of cooling water while stopping the sheet bar or performing oscillation cooling. In the above explanation, the rapid cooling apparatus 41 is arranged in a position near to the reversible rolling mill 31 and the slow cooling apparatus 42 is arranged at a far position therefrom. However, when the distance between the rough rolling mills 31 and 32 is sufficiently long, the slow cooling apparatus 42 may be arranged near to the reversible rolling mill 31 and the rapid cooling apparatus 41 may be arranged far therefrom.

INDUSTRIAL APPLICABILITY

According to aspects of the invention, hot-rolled steel strips can be produced efficiently while preventing the temperature of the surface layer of the sheet bar from falling below a phase transformation temperature during the cooling conducted prior to the controlled-rolling and decreasing a time required up to starting the controlled-rolling.

DESCRIPTION OF REFERENECE SYMBOLS

1 continuous heating furnace
2 sizing press
3 rough rolling mill group
4 edger
5 crop shear
6 finish rolling mill group
7 runout table
8 coiler
10 sheet bar
31 reversible rolling mill
32 non-reversible rolling mill
33 radiation thermometer
41 rapid cooling apparatus
42 slow cooling apparatus
51 rolling pass schedule preparing apparatus
52 cooling pass schedule preparing apparatus

The invention claimed is:

1. A production equipment line for a hot-rolled steel strip comprising a rough rolling mill group comprised of plural rough rolling mills for hot rolling a material to be rolled which is heated up to a predetermined temperature to a finish rolling start sheet thickness and a finish rolling mill group comprised of plural finish rolling mills for controlled-rolling the material to be rolled to a final sheet thickness, characterized in that at least one of the plural rough rolling mills is a reversible rolling mill, and a slow cooling apparatus for slowly cooling the material to be rolled at a water volume density of less than 1000 L/min·m$^2$ and a rapid cooling apparatus which is arranged next to the slow cooling apparatus in a rolling direction and rapidly cools the material to be rolled after the slow-cooling at a water volume density of not less than 1000 L/min·m$^2$ are arranged on only one side of the reversible rolling mill between the reversible rolling mill and another one of the plural rough rolling mills and on an upstream side of the finish rolling mill group.

2. The production equipment line for a hot-rolled steel strip according to claim 1, wherein at least a rough rolling mill arranged on a most downstream side among the plural rough rolling mills is a reversible rolling mill.

3. The production equipment line for a hot-rolled steel strip according to claim 1, wherein the rapid cooling apparatus and the slow cooling apparatus are arranged in the order of the rapid cooling apparatus and the slow cooling apparatus from the side near to the reversible rolling mill.

4. The production equipment line for a hot-rolled steel strip according to claim 2, wherein the rapid cooling apparatus and the slow cooling apparatus are arranged in the order of the rapid cooling apparatus and the slow cooling apparatus from the side near to the reversible rolling mill.

5. The production equipment line for a hot-rolled steel strip according to claim 1, wherein the material to be rolled is slowly cooled by the slow cooling apparatus when the sheet thickness is not less than 80 mm and rapidly cooled by the rapid cooling apparatus when the sheet thickness is less than 80 mm.

6. The production equipment line for a hot-rolled steel strip according to claim 2, wherein the material to be rolled is slowly cooled by the slow cooling apparatus when the sheet thickness is not less than 80 mm and rapidly cooled by the rapid cooling apparatus when the sheet thickness is less than 80 mm.

7. The production equipment line for a hot-rolled steel strip according to claim 3, wherein the material to be rolled is slowly cooled by the slow cooling apparatus when the sheet thickness is not less than 80 mm and rapidly cooled by the rapid cooling apparatus when the sheet thickness is less than 80 mm.

8. The production equipment line for a hot-rolled steel strip according to claim 4, wherein the material to be rolled is slowly cooled by the slow cooling apparatus when the sheet thickness is not less than 80 mm and rapidly cooled by the rapid cooling apparatus when the sheet thickness is less than 80 mm.

9. The production equipment line for a hot-rolled steel strip according to claim 1, wherein each cooling time in the slow cooling apparatus and the rapid cooling apparatus is set so as to render a surface temperature of the material to be rolled during the cooling into not lower than 600° C.

10. The production equipment line for a hot-rolled steel strip according claim 1, wherein the final sheet thickness at an exit side of a final-stage finish rolling mill among the plural finish rolling mills is not less than 12 mm.

11. A method for producing a hot-rolled steel strip, the method comprising hot rolling a material to be rolled which is heated to a predetermined temperature by a plurality of rough rolling mills to provide a finish rolling start sheet thickness and controlled-rolling the material to be rolled to a final sheet thickness by a plurality of finish rolling mills, characterized in that at least one of the plural rough rolling mills is a reversible rolling mill, and the material to be rolled is slowly cooled by a slow cooling apparatus at a water volume density of less than 1000 L/min·m$^2$ and the material to be rolled after the slow cooling is rapidly cooled by a rapid cooling apparatus arranged next to the slow cooling apparatus in a rolling direction at a water volume density of not less than 1000 L/min·m$^2$ arranged on only one side of the reversible rolling mill between the reversible rolling mill and another one of the plural rough rolling mills and on an upstream side of the plurality of finish rolling mills.

12. The production method for a hot-rolled steel strip according to claim 11, wherein at least a rough rolling mill arranged on a most downstream side among the plural rough rolling mills is a reversible rolling mill.

13. The production method for a hot-rolled steel strip according to the claim 11, wherein the rapid cooling apparatus and the slow cooling apparatus are arranged in the order of the rapid cooling apparatus and the slow cooling apparatus from the side near to the reversible rolling mill.

14. The production method for a hot-rolled steel strip according to the claim 12, wherein the rapid cooling apparatus and the slow cooling apparatus are arranged in the order of the rapid cooling apparatus and the slow cooling apparatus from the side near to the reversible rolling mill.

15. The production method for a hot-rolled steel strip according to claim 11, wherein the material to be rolled is slowly cooled by the slow cooling apparatus when the sheet thickness is not less than 80 mm and rapidly cooled by the rapid cooling apparatus when the sheet thickness is less than 80 mm.

16. The production method for a hot-rolled steel strip according to claim 12, wherein the material to be rolled is slowly cooled by the slow cooling apparatus when the sheet thickness is not less than 80 mm and rapidly cooled by the rapid cooling apparatus when the sheet thickness is less than 80 mm.

17. The production method for a hot-rolled steel strip according to claim 13, wherein the material to be rolled is slowly cooled by the slow cooling apparatus when the sheet thickness is not less than 80 mm and rapidly cooled by the rapid cooling apparatus when the sheet thickness is less than 80 mm.

18. The production method for a hot-rolled steel strip according to claim 14, wherein the material to be rolled is slowly cooled by the slow cooling apparatus when the sheet thickness is not less than 80 mm and rapidly cooled by the rapid cooling apparatus when the sheet thickness is less than 80 mm.

19. The production method for a hot-rolled steel strip according to claim 11, wherein the material to be rolled is cooled by the slow cooling apparatus and rapid cooling apparatus so as to render a surface temperature of the material to be rolled into not lower than 600° C. during the cooling.

20. The production method for a hot-rolled steel strip according to claim 11, wherein the final sheet thickness at an exit side of a final-stage finish rolling mill among the plural finish rolling mills is not less than 12 mm.

* * * * *